US009896845B2

(12) United States Patent
Sorkin

(10) Patent No.: US 9,896,845 B2
(45) Date of Patent: Feb. 20, 2018

(54) SPINDLE LOCK ANCHOR FOR POST TENSIONED CONCRETE MEMBER

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 15/225,907

(22) Filed: Aug. 2, 2016

(65) Prior Publication Data

US 2017/0037622 A1 Feb. 9, 2017

Related U.S. Application Data

(60) Provisional application No. 62/200,918, filed on Aug. 4, 2015.

(51) Int. Cl.
*E04C 5/08* (2006.01)
*E04C 5/12* (2006.01)

(52) U.S. Cl.
CPC ..... *E04C 5/122* (2013.01); *E04C 5/125* (2013.01); *E04C 5/127* (2013.01)

(58) Field of Classification Search
CPC ..... E04C 5/122; E04C 5/125; E04C 5/161; E04B 1/06; E04B 1/22; B28B 23/046
See application file for complete search history.

(56) References Cited

U.S. PATENT DOCUMENTS 2,355,403 A 8/1944 Tripp
3,049,368 A * 8/1962 Gerhart ..... B60P 7/0807 403/365
3,137,971 A 6/1964 Rhodes
3,501,183 A * 3/1970 Stratienko ..... F16D 1/08 403/370
3,559,270 A * 2/1971 Beghi ..... E04C 5/125 29/282
3,685,934 A 8/1972 Huber et al.
3,698,749 A * 10/1972 Yonkers ..... E04C 5/122 174/177
3,766,609 A 10/1973 Brandestini et al.
3,956,797 A 5/1976 Brandestini et al.
4,160,615 A * 7/1979 Baldwin ..... E21D 21/0026 405/259.3
4,363,462 A * 12/1982 Wlodkowski ..... E04C 5/12 24/115 M
4,623,277 A * 11/1986 Wayne ..... F16D 1/05 403/314

(Continued)

FOREIGN PATENT DOCUMENTS

GB 2363007 B 3/2004
JP 2007070917 A 3/2007
KR 101174206 01 8/2012

OTHER PUBLICATIONS

International Search Report and Written Opinion issued in international patent application No. PCT/US2016/045085, dated Oct. 7, 2016 (11 pages).

*Primary Examiner* — Christine T Cajilig
(74) *Attorney, Agent, or Firm* — Adolph Locklar

(57) ABSTRACT

An anchor is disclosed. The anchor may include an anchor body, the anchor body having an internal passage, and a lock nut, the lock nut having an internal tapered surface defining a forcing cone. The lock nut may be coupled to the anchor body. The anchor may also include a spindle, the spindle positioned within the internal passage and threadedly coupled to the lock nut. The spindle may have an expansion wedge.

20 Claims, 3 Drawing Sheets

(56) References Cited

U.S. PATENT DOCUMENTS 4,896,470 A 1/1990 Sorkin
5,072,558 A 12/1991 Sorkin et al.
5,271,199 A 12/1993 Northern
5,701,707 A 12/1997 Sorkin
5,749,185 A 5/1998 Sorkin
5,755,065 A 5/1998 Sorkin
5,788,398 A 8/1998 Sorkin
5,897,102 A * 4/1999 Sorkin ..... E04C 5/12 249/43
6,023,894 A * 2/2000 Sorkin ..... E04C 5/122 24/122.6
6,027,278 A 2/2000 Sorkin
6,098,356 A 8/2000 Sorkin
6,381,912 B1 * 5/2002 Sorkin ..... E04C 5/08 24/459
6,393,781 B1 5/2002 Sorkin
6,560,939 B2 5/2003 Sorkin
6,588,193 B2 7/2003 Hayes
6,631,596 B1 10/2003 Sorkin
6,761,002 B1 * 7/2004 Sorkin ..... E04C 5/12 403/374.1
6,817,148 B1 11/2004 Sorkin
6,843,031 B1 1/2005 Sorkin
6,883,280 B2 4/2005 Hayes
7,174,685 B2 2/2007 Hayes
7,216,842 B2 5/2007 Watson
7,275,347 B2 10/2007 Hayes
7,360,342 B2 4/2008 Hayes et al.
7,424,792 B1 9/2008 Sorkin
7,618,217 B2 11/2009 Henderson
7,621,103 B1 11/2009 Sorkin
7,676,997 B1 3/2010 Sorkin
7,726,082 B2 6/2010 Hayes et al.
7,762,029 B2 7/2010 Hayes et al.
7,765,752 B2 8/2010 Hayes et al.
7,793,473 B2 9/2010 Sorkin
7,823,345 B1 * 11/2010 Sorkin ..... E04C 5/122 24/122.3
7,841,061 B1 * 11/2010 Sorkin ..... E04C 5/122 24/122.3
7,841,140 B1 * 11/2010 Sorkin ..... E04C 5/10 403/314
7,856,774 B1 * 12/2010 Sorkin ..... E04C 5/122 24/122.6
7,866,009 B1 1/2011 Sorkin
D635,278 S 3/2011 Stanford
7,950,196 B1 * 5/2011 Sorkin ..... E04C 5/10 403/314
7,950,197 B1 * 5/2011 Sorkin ..... E04C 5/10 403/314
7,963,078 B1 6/2011 Sorkin
8,015,774 B1 9/2011 Sorkin
8,051,615 B2 11/2011 Mathews et al.
8,065,845 B1 11/2011 Sorkin
8,069,624 B1 * 12/2011 Sorkin ..... E04C 5/12 403/314
8,087,204 B1 1/2012 Sorkin
8,104,246 B2 1/2012 Nieto et al.
8,146,306 B2 4/2012 Hayes et al.
8,251,344 B1 8/2012 Sorkin
8,276,334 B2 10/2012 Mathews et al.
8,286,309 B2 10/2012 Landry
8,756,885 B1 6/2014 Mathews et al.
8,904,721 B2 12/2014 Pantelides et al.
8,925,279 B2 1/2015 Pantelides et al.
8,931,152 B2 1/2015 Parente et al.
9,096,986 B2 8/2015 Henderson
9,097,014 B1 8/2015 Sorkin
9,163,405 B2 10/2015 Mathews et al.
9,303,406 B2 4/2016 Sorkin
9,317,191 B2 4/2016 Stanford
9,399,869 B2 7/2016 Sorkin
2002/0007604 A1 * 1/2002 Wallstein ..... E04C 5/122 52/223.13
2006/0179742 A1 8/2006 Mathews et al.
2006/0201083 A1 9/2006 Hayes et al.
2008/0083130 A1 4/2008 Parkes et al.
2012/0011788 A1 1/2012 Nieto et al.
2015/0300021 A1 10/2015 Hayes
2015/0330078 A1 11/2015 Sorkin
2015/0345142 A1 12/2015 Mathews et al.
2016/0208490 A1 7/2016 Wilson

* cited by examiner

SPINDLE LOCK ANCHOR FOR POST TENSIONED CONCRETE MEMBER

CROSS-REFERENCE TO RELATED APPLICATIONS

This application is a nonprovisional application that claims priority from U.S. provisional application No. 62/200,918, filed Aug. 4, 2015, which is hereby incorporated by reference in its entirety.

TECHNICAL FIELD/FIELD OF THE DISCLOSURE

The present disclosure relates generally to post-tensioned, pre-stressed concrete construction. The present disclosure relates specifically to anchors for use therein.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, sports courts, and other structures.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a tension member is tensioned after the concrete has attained a desired strength by use of a post-tensioning tendon. The post-tensioning tendon may include for example and without limitation, anchor assemblies, the tension member, and sheathes. Traditionally, a tension member is constructed of a material that can be elongated and may be a single or a multi-strand cable. Typically, the tension member may be formed from a metal or composite material, such as reinforced steel. The post-tensioning tendon conventionally includes an anchor assembly at each end. The post-tensioning tendon is fixedly coupled to a fixed anchor assembly positioned at one end of the post-tensioning tendon, the "fixed-end", and stressed at the stressed anchor assembly positioned at the opposite end of the post-tensioning tendon, the "stressing-end" of the post-tensioning tendon.

Post-tension members are conventionally formed from a strand and a sheath. The strand is conventionally formed as a single or multi-strand metal cable. The strand is conventionally encapsulated within a polymeric sheath extruded thereabout to, for example, prevent or retard corrosion of the metal strand by protecting the metal strand from exposure to corrosive or reactive fluids. Likewise, the sheath may prevent or retard concrete from bonding to the strand and preventing or restricting movement of the sheath during post-tensioning. The sheath may be filled with grease to further limit the exposure of the metal strand and allow for increased mobility. Because the metal strand and the polymeric sheath are formed from different materials, the thermal expansion and contraction rates of the metal strand and polymeric sheath may differ. During conventional manufacturing, the sheaths are formed by hot extrusion over the metal strand. When the tension members are coiled for transport and storage, uneven thermal contraction may occur as the tendon cools. When installed as a post-tensioning tendon in a pre-stressed concrete member, cooling of the sheath may cause separation of the sheath from an anchorage, potentially exposing the metal strand to corrosive or reactive fluids.

SUMMARY

The present disclosure provides an anchor. The anchor includes an anchor body, the anchor body having an internal passage, and a lock nut, the lock nut having an internal tapered surface defining a forcing cone. The lock nut is coupled to the anchor body. The anchor also includes a spindle, the spindle positioned within the internal passage and threadedly coupled to the lock nut. The spindle has an expansion wedge.

The present disclosure also provides for a post-tensioning tendon. The post-tensioning tendon includes a tension member including a strand and a sheath where the sheath is positioned about the strand. The post-tensioning tendon also includes a first anchor coupled to a first end of the tension member and a second anchor coupled to a second end of the tension member. Each of the anchors include an anchor body, the anchor body having an internal passage, and a lock nut, the lock nut having an internal tapered surface defining a forcing cone. The lock nut is coupled to the anchor body. The anchors also include a spindle, the spindle positioned within the internal passage and threadedly coupled to the lock nut. The spindle has an expansion wedge, and the sheath is gripped between the expansion wedge and the forcing cone.

In addition, the present disclosure provides for a method of coupling a tension member to an anchor for forming a post-tensioning tendon. The method includes providing a tension member including a strand and a sheath, where the sheath is positioned about the strand. The method also includes providing an anchor. The anchor includes an anchor body, where the anchor body has an internal passage and a lock nut, the lock nut having an internal tapered surface defining a forcing cone. The lock nut is coupled to the anchor body. The anchor also includes a spindle, the spindle positioned within the internal passage and threadedly coupled to the lock nut. The spindle has an expansion wedge, and the sheath is gripped between the expansion wedge and the forcing cone. The method also includes removing a portion of a first end of the sheath from a first end of the tension member exposing a first end of the strand and inserting the first end of the tension member into the anchor. In addition, the method includes inserting the first end of the strand through the spindle and inserting the sheath between the expansion wedge and the forcing cone. The method also includes tightening the lock nut onto the spindle such that the sheath is compressed between the expansion wedge and the forcing cone and coupling the strand to the anchor.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
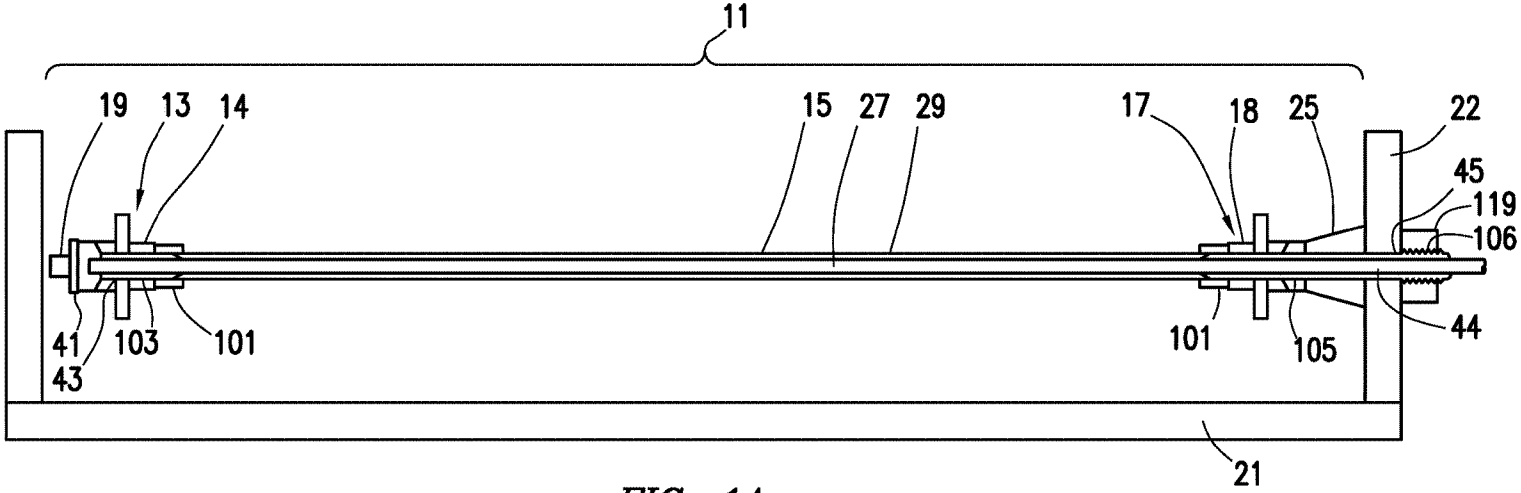
FIGS. 1A, 1B depict a partial cross section of a concrete post-tensioning tendon within a concrete form consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
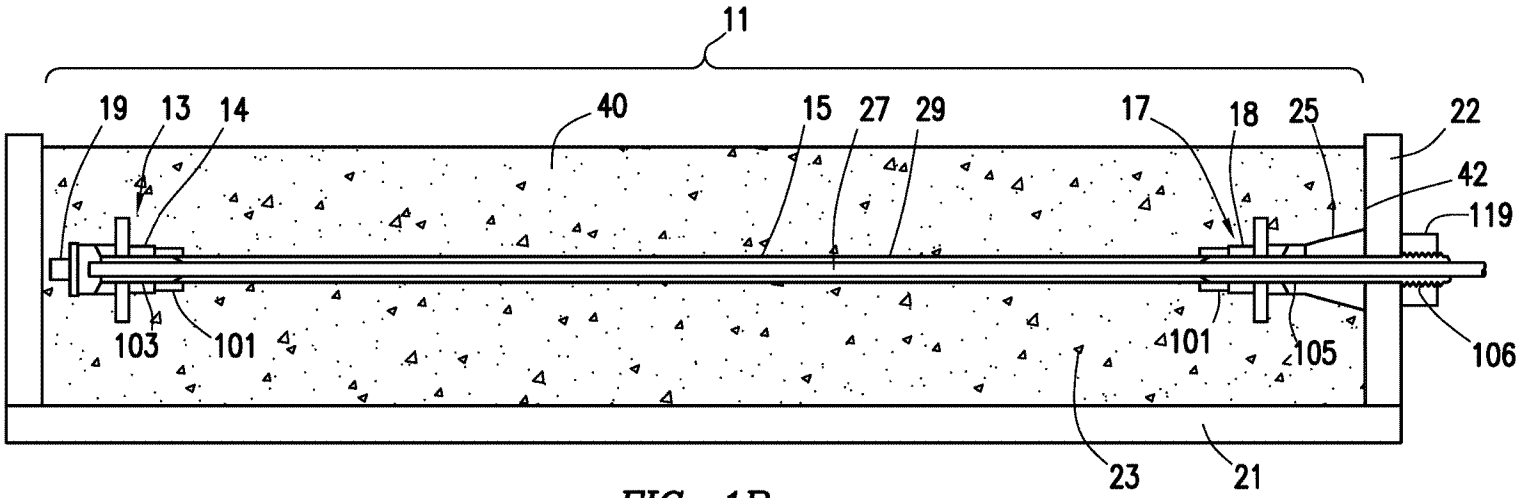

When stressing concrete member 40, anchoring systems may be provided to hold the tension member before and after stressing. In some embodiments, as depicted in FIGS. 1A, 1B, post-tensioning tendon 11 may be positioned within concrete form 21. Concrete form 21 is a form into which concrete may be poured to form concrete member 40. Post-tensioning tendon 11 may include for example and without limitation fixed end anchor 13, tension member 15, and stressing end anchor 17. As depicted in FIG. 1A, in some embodiments, fixed end anchor 13 may include fixed end anchor body 14. Fixed-end anchor body 14 may be positioned within concrete form 21 such that fixed-end anchor body 14 will be encased in concrete 23 after concrete is poured into concrete form 21. In some embodiments, fixed end cap 19 may be positioned at distal end 41 of fixed end anchor body 14. Fixed end cap 19 may, in certain embodiments, protect tension member 15 from corrosion after concrete 23 is poured by preventing or retarding corrosive or reactive fluids or concrete from contacting tension member 15.

Stressing end anchor 17 may include stressing end anchor body 18, positioned within concrete form 21 such that stressing end anchor body 18 is within concrete 23. Pocket former 25 may be positioned between the end of stressing end anchor body 18 and end wall 22 of concrete form 21. Pocket former 25 may prevent or retard concrete 23 from filling space between stressing end anchor body 18 and concrete form edge 42 of the resultant concrete member 40 formed by concrete 23 within concrete form 21. Pocket former 25 may allow access to tension member 15 from outside concrete member 40 once concrete member 40 is hardened and concrete form 21 is removed.

As used herein, stressing end anchor 17 and fixed end anchor 13 may be referred to as "first anchor" and "second anchor," or vice versa.

In some embodiments, tension member 15 may include strand 27 and sheath 29. Strand 27 may be a single or multi-strand metal cable. Sheath 29 may be tubular or generally tubular and may be positioned about strand 27. In some embodiments, space between strand 27 and sheath 29 may be filled or partially filled with a filler such as grease. When installing tension member 15, in some embodiments, a length of sheath 29 may be removed from first end 43 of tension member 15, exposing strand 27. Strand 27 may be inserted through fixed end anchor body 14 and secured thereto, for example and without limitation, by one or more wedges. After strand 27 is secured, fixed end anchor body 14 may be installed in concrete form 21. Tension member 15 may be positioned within concrete form 21 and tension member 15 may be cut to correspond with the length of concrete form 21. In some embodiments, a length of sheath 29 may be removed from second end 44 of tension member 15, exposing strand 27. Strand 27 may be inserted through stressing end anchor body 18. After insertion of strand 27 through stressing end anchor body 18, stressing end anchor 17 may be positioned within concrete form 21 such that pocket former 25 contacts end wall 22 of concrete form 21. End wall 22 may include strand aperture 45 through which strand 27 may extend.

Figure 2:
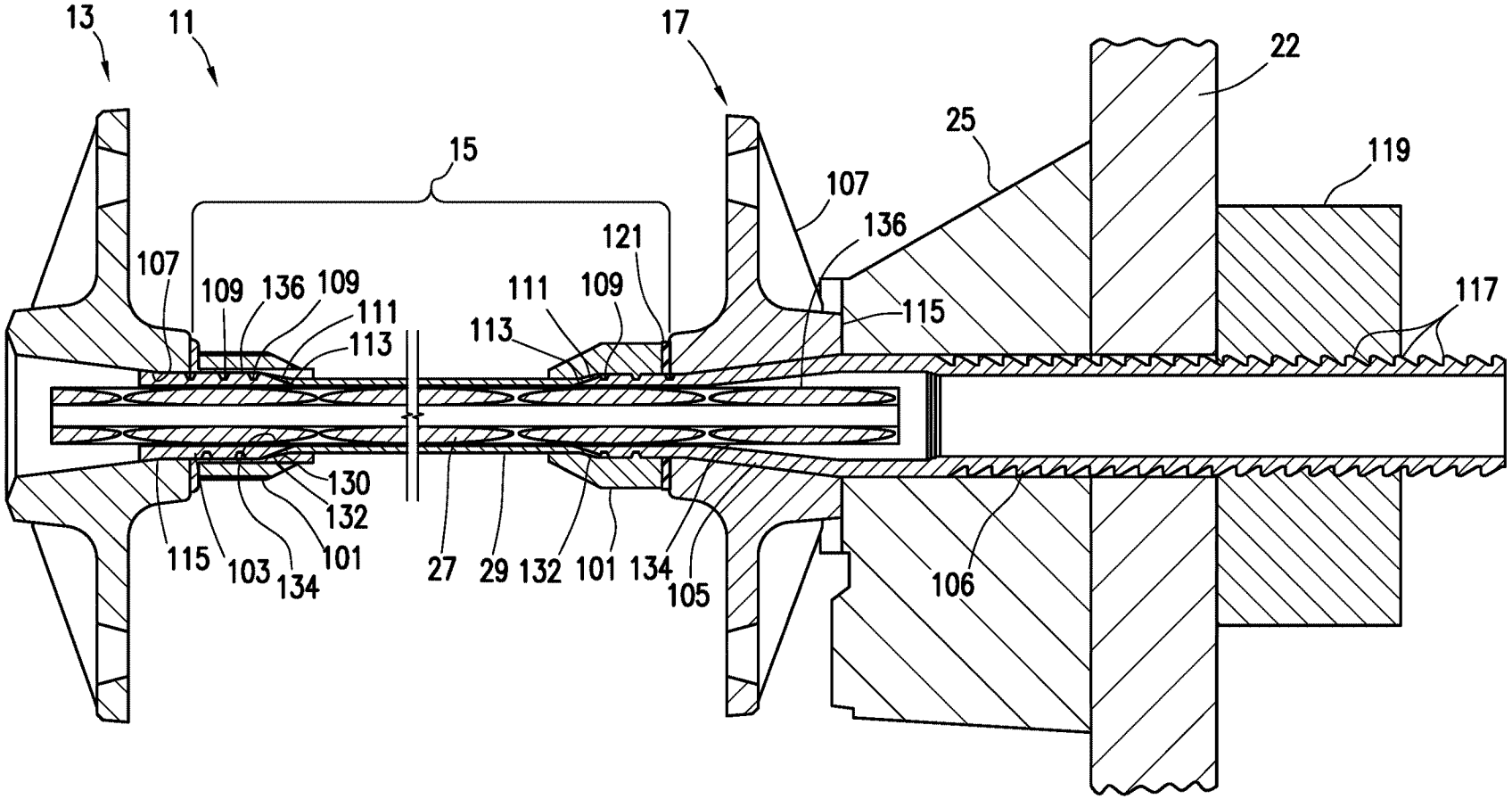
FIG. 2 depicts a cross section view of a post-tensioning tendon within a spindle lock anchor consistent with at least one embodiment of the present disclosure.

In some embodiments, as depicted in FIGS. 1A, 1B, and 2, when tension member 15 is inserted into stressing end anchor body 18 and fixed end anchor body 14, sheath 29 may be coupled to stressing end anchor body 18 and fixed end anchor body 14 to, for example and without limitation, prevent or restrict sheath 29 from pulling away from the respective anchors and exposing strand 27 to concrete 23.

In some embodiments, fixed end anchor 13 may include lock nut 101 and spindle 103. Likewise, stressing end anchor 17 may include lock nut 101 and spindle 105. Spindles 103, 105 may be tubular or generally tubular members having cylindrical or generally cylindrical inner surfaces 134 defining spindle inner passages 136 through which strand 27 may pass. Spindles 103, 105 may be positioned within internal passage 107 of the corresponding anchor bodies 14, 18. In some embodiments, spindles 103, 105 may include threads 109 to threadedly couple spindles 103, 105 to a respective lock nut 101.

Figure 3:
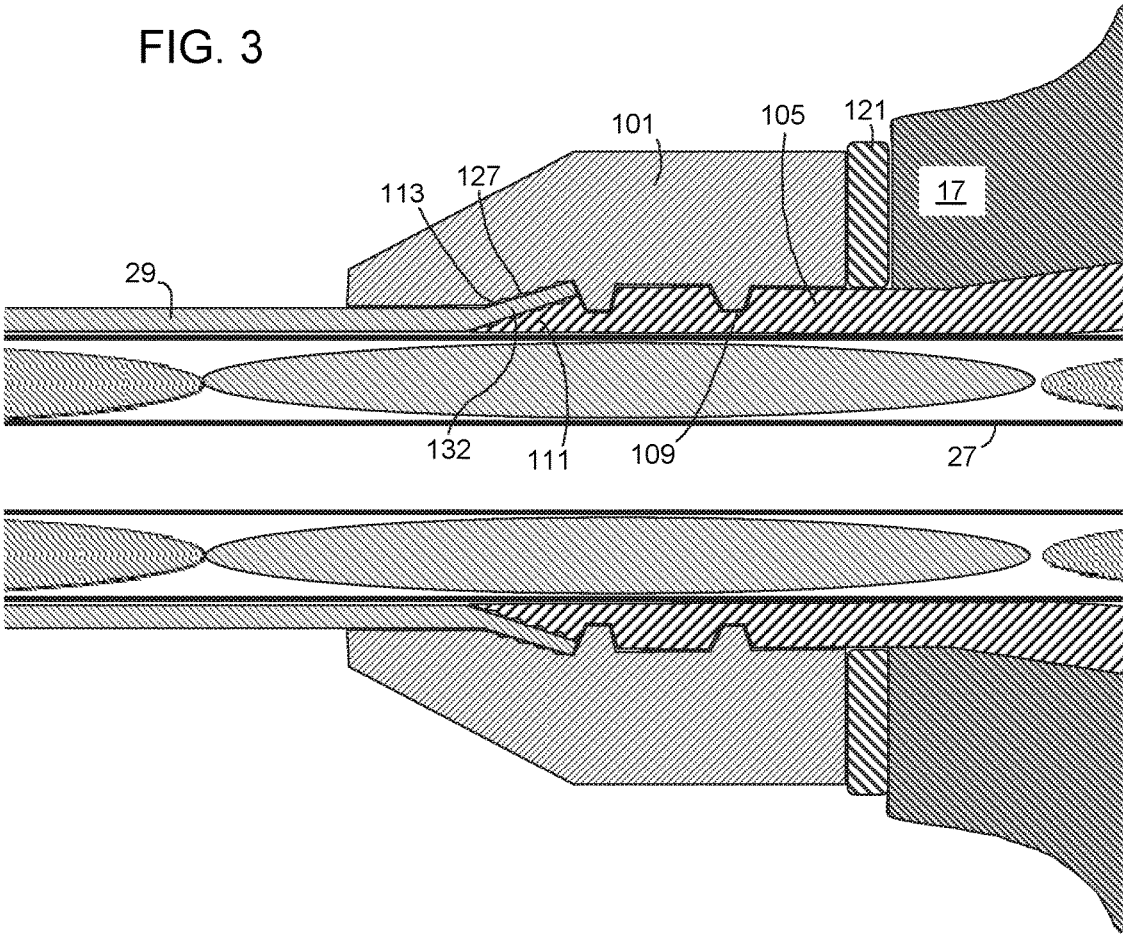
FIG. 3 depicts an enlarged view of a portion of FIG. 2.

In some embodiments, lock nuts 101 and spindles 103, 105 may grip the respective ends of sheath 29 when coupled. As best depicted in FIG. 3, spindles 103, 105 may each include an expansion wedge 111. Expansion wedge 111 may be positioned within an expansion portion 132 at an end of sheath 29 and may expand expansion portion 132 radially outward as expansion wedge 111 is inserted. Likewise, in some embodiments, lock nuts 101 may include an internal tapered surface 130 defining a forcing cone 113 corresponding to expansion wedges 111 such that, as lock nuts 101 are tightened, expansion portion 132 of sheath 29 is gripped between forcing cone 113 and expansion wedge 111. In some embodiments, one or both of expansion wedge 111 and forcing cone 113 may be smooth or may include a grip enhancing surface feature 127 such as teeth, grooves, or any other grip enhancing surface features known in the art.

In some embodiments, spindles 103, 105 may couple to fixed end anchor body 14 or stressing end anchor body 18 by tensile forces applied when lock nuts 101 are tightened thereonto. In some embodiments, spindles 103, 105 may include a retention feature. The retention feature may transfer the tensile force onto fixed end anchor body 14 or stressing end anchor body 18 and prevent or restrict spindles 103, 105 from being pulled through fixed end anchor body 14 or stressing end anchor body 18. In some embodiments, the retention feature may be an edge, detent, extension, or, as depicted in FIG. 2, conical retaining profile 115.

In some embodiments, one or more of spindles 103, 105 may couple fixed end anchor body 14 or stressing end anchor body 18 to end wall 22 of concrete form 21. As depicted in FIGS. 1A, 1B, and 2, spindle 105 includes spindle extension 106; spindle extension 106 may thread through strand aperture 45 in end wall 22 through which strand 27 extends. In some embodiments, spindle extension 106 may include external threads 117. External threads 117 may threadedly couple spindle extension 106 with spindle nut 119. Spindle nut 119 may allow stressing end anchor body 18 to be retained to end wall 22 during concrete pouring.

In some embodiments, after concrete 23 is poured, spindles 103, 105 may be left in fixed end anchor 13. In some embodiments, after concrete 23 is poured and set as depicted in FIG. 1B, spindle 105 may be removed from stressing end anchor body 18 by unthreading spindle 105 from lock nut 101. Although sheath 29 may no longer be retained between extended spindle 105 and lock nut 101 after concrete pouring, sheath 29 may be prevented from retracting from stressing end anchor body 18 by concrete 23. As understood in the art, concrete 23 surrounding sheath 29 may conform to surface irregularities of sheath 29 and may adhere thereto, thus preventing or restricting any contraction of sheath 29.

In some embodiments, one or more seals may be positioned to prevent or restrict concrete 23 from ingressing into tension member 15 that may prevent or retard the tensioning of strand 27. In some embodiments, as depicted in FIG. 2, gasket 121 may be positioned between lock nut 101 and stressing end anchor body 18.

Although described specifically with respect to fixed end anchor 13 and stressing end anchor 17, a spindle such as spindles 103, 105 may be utilized with either a fixed end anchor or stressing end anchor. Furthermore, a spindle such as spindles 103, 105 may be used with an intermediate anchor. An intermediate anchor, as understood in the art, may be an anchor used between adjacent concrete members which are poured and stressed sequentially utilizing the same tension member 15.

Although fixed end anchor 13 and stressing end anchor 17 are depicted as unencapsulated or bare anchors, such as those formed from ductile iron, fixed end anchor 13 and stressing end anchor 17 may be encapsulated-type anchors without deviating from the scope of this disclosure and may be formed from any material. Non-limiting examples of encapsulated anchors are disclosed in U.S. Pat. Nos. 4,896,470; 5,072,558; 5,701,707; 5,749,185; 5,755,065; 6,098,356; 6,381,912; 6,560,939; 6,761,002; 6,817,148; 6,843,031; and 8,065,845 which are incorporated herein by reference. In some embodiments, spindles 103, 105 may be formed from a nonconductive material such as a polymer. In some such embodiments, spindles 103, 105 may act to electrically insulate strand 27, fixed end anchor 13, and stressing end anchor 17. This electric insulation may prevent or retard galvanic corrosion from occurring due to contact between strand 27, fixed end anchor 13, or stressing end anchor 17 when strand 27, fixed end anchor 13, and stressing end anchor 17 are formed from different metals.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Unless explicitly stated otherwise, nothing herein is intended to be a definition of any word or term as generally used by a person of ordinary skill in the art, and nothing herein is a disavowal of any scope of any word or term as generally used by a person of ordinary skill in the art.

The invention claimed is:

1. An anchor for a post-tensioning tendon comprising a strand encased in a sheath, the anchor comprising:

an anchor body, the anchor body having an internal passage therethrough;

a lock nut, the lock nut having an internal tapered surface defining a forcing cone; and a spindle, the spindle positioned within the internal passage and threadedly coupled to the lock nut, the spindle having an expansion wedge corresponding to the forcing cone;

wherein the expansion wedge and the forcing cone cooperate to grip the sheath therebetween.

2. The anchor of claim 1, wherein the spindle further comprises a spindle extension, the spindle extension, the spindle extension having an external thread, the external thread threadedly coupling the spindle extension with a spindle nut.

3. The anchor of claim 1 further comprising a gasket positioned between the lock nut and the anchor body.

4. The anchor of claim 1, wherein the spindle further comprises a retention feature, the retention feature being an edge, detent, extension, or retaining profile.

5. The anchor of claim 1, wherein the anchor is a fixed end anchor, a stressing end anchor, or an intermediate anchor.

6. The anchor of claim 1, wherein at least one of the expansion wedge or the forcing cone has a grip enhancing surface feature, wherein the grip enhancing surface feature includes teeth or grooves.

7. The anchor of claim 1, wherein the spindle is formed from a non-conductive material.

8. A post-tensioning tendon comprising:

a tension member comprising a strand and a sheath, the sheath positioned about the strand;

a first anchor coupled to a first end of the tension member, and a second anchor coupled to a second end of the tension member, each anchor including:

an anchor body, the anchor body having an internal passage;

a lock nut, the lock nut having an internal tapered surface defining a forcing cone, the lock nut coupled to the anchor body; and a spindle, the spindle positioned within the internal passage and threadedly coupled to the lock nut, the spindle having an expansion wedge, the sheath gripped between the expansion wedge and the forcing cone.

9. The post-tensioning tendon of claim 8, wherein the spindle of at least one of the first or second anchor further comprises a spindle extension, the spindle extension having an external thread, the spindle extension threadedly coupled with a spindle nut by the external thread, the spindle extension threaded through a strand aperture in an end wall of a concrete form, the anchor body coupled to the end wall by the spindle nut.

10. The post-tensioning tendon of claim 9 further comprising a pocket former, the pocket former positioned between the anchor body of the first or second anchor and the end wall.

11. The post-tensioning tendon of claim 8, further comprising a gasket positioned between the lock nut and the anchor body of at least one of the first or second anchor.

12. The post-tensioning tendon of claim 8 further comprising a fixed end cap, the fixed end cap positioned at the distal end of either the first or second anchor.

13. The post-tensioning tendon of claim 8, wherein at least one of the expansion wedge or the forcing cone of at least one of the first or second anchor has a grip enhancing surface feature, wherein the surface feature includes teeth or grooves.

14. The post-tensioning tendon of claim 8, wherein the spindle and the anchor body are formed from different materials.

15. A method of coupling a tension member to an anchor for forming a post-tensioning tendon comprising:

providing a tension member comprising a strand and a sheath, the sheath being positioned about the strand;

providing an anchor, the anchor including:

an anchor body, the anchor body having an internal passage;

a lock nut, the lock nut having an internal tapered surface defining a forcing cone, the lock nut coupled to the anchor body; and a spindle, the spindle positioned within the internal passage and threadedly coupled to the lock nut, the spindle having an expansion wedge, the sheath gripped between the expansion wedge and the forcing cone;

removing a portion of a first end of the sheath from a first end of the tension member exposing a first end of the strand;

inserting the first end of the tension member into the anchor;

inserting the first end of the strand through the spindle;

inserting the sheath between the expansion wedge and the forcing cone;

tightening the lock nut onto the spindle such that the sheath is compressed between the expansion wedge and the forcing cone; and coupling the strand to the anchor.

16. The method of claim 15, wherein the spindle further comprises a spindle extension, the spindle extension threaded through a strand aperture in an end wall of a concrete form, the anchor body coupled to the end wall by the spindle nut, and wherein the method further comprises the operations of:

positioning the spindle extension through the end wall;

threading the spindle nut onto the spindle extension such that the anchor body is coupled to the end wall.

17. The method of claim 16 further comprising:

filling the concrete element with concrete;

setting the concrete;

disengaging the spindle from the lock nut; and removing the spindle from the anchor body.

18. The method of claim 15 further comprising electrically insulating the strand and the anchor using the spindles.

19. The method of claim 15 further comprising positioning seals between the lock nut and the anchor.

20. The method of claim 15 further comprising preventing the spindle from being pulled through the anchor body using a retention feature.

* * * * *